United States Patent [19]

Mulford

[11] Patent Number: 4,658,552

[45] Date of Patent: Apr. 21, 1987

[54] VENTED EXTERIOR BUILDING WALL AND ROOF STRUCTURES

[76] Inventor: Cass E. Mulford, R.D. 3, Canastota, N.Y. 13032

[21] Appl. No.: 682,163

[22] Filed: Dec. 17, 1984

Related U.S. Application Data

[63] Continuation-in-part of Ser. No. 371,905, Apr. 26, 1982, Pat. No. 4,488,390.

[51] Int. Cl.[4] ..... F24F 7/00; E04B 1/70

[52] U.S. Cl. ..... 52/90; 52/101; 52/105; 52/303; 98/31; 98/42.19

[58] Field of Search ..... 52/302, 303, 90, 657, 52/DIG. 6, 105, 101, 712, 713; 98/31, 32, 42.18, 42.19; 403/401, 402, 27; 411/466, 476, 463, 468, 467

[56] References Cited

U.S. PATENT DOCUMENTS

| | | | |
|---|---|---|---|
| 819,876 | 5/1906 | Gifford | 52/657 |
| 2,154,599 | 4/1939 | Beckwith | 52/657 |
| 2,645,824 | 7/1953 | Titsworth | 52/303 |
| 2,719,475 | 10/1955 | Royall | 98/42.19 |
| 2,827,676 | 3/1958 | Sanford | 52/639 |
| 3,191,238 | 6/1965 | Olson | 403/401 |
| 3,204,379 | 9/1965 | Osborn | 52/305 |
| 3,258,282 | 6/1966 | Koenigshof | 52/105 |
| 3,414,300 | 12/1968 | Spane | 403/402 |
| 3,985,459 | 10/1976 | Gilb | 52/639 |
| 4,410,294 | 10/1983 | Gilb | 403/27 |

FOREIGN PATENT DOCUMENTS

| | | | |
|---|---|---|---|
| 850462 | 12/1939 | France | 403/402 |

*Primary Examiner*—John E. Murtagh

*Attorney, Agent, or Firm*—Charles S. McGuire

[57] ABSTRACT

The invention relates to exterior wall and roof constructions wherein a space is provided between an outer sheathing layer and the underlying structure for passage of air to assist in heating, cooling and ventilating functions. Perforated channel members are installed in the area at which air enters and/or leaves the vented space, permitting free flow of air while preventing entry of insects, rodents, or other foreign materials into the space. Means may be optionally provided for blocking off air flow through the vent space when desired to assist in heating and cooling functions. Plenums and ductwork may be provided for recirculation of air from the vented spaces to other portions of the structure. In one embodiment, a vented roof structure is provided which may advantageously be employed in conjunction with an interior, cathedral-type ceiling. An angle bracket useful in both marking roof rafter members for cutting and in assembly thereof is also disclosed.

9 Claims, 7 Drawing Figures

2

VENTED EXTERIOR BUILDING WALL AND ROOF STRUCTURES

CROSS REFERENCE TO RELATED APPLICATION

This is a continuation-in-part of application Ser. No. 371,905, filed Apr. 26, 1982, now U.S. Pat. No. 4,488,390, issued Dec. 18, 1984.

BACKGROUND OF THE INVENTION

The present invention relates to building wall and roof constructions and, more particularly, to a vented, exterior building wall and/or roof having a free-circulating air space adjacent an outer sheathing layer, as well as other features.

One of the principal objects of the invention to provide an exterior building wall or roof construction including means which permit air to circulate from the lower to the upper part of a space provided to circulate from the lower to the upper part of a space provided between an outer sheathing layer and underlying structure while effectively preventing entry of insects or other foreign materials into such space.

Another object is to provide an exterior wall structure having a space for circulation of air between layers of the wall which may be selectively opened or closed off.

A further object is to provide a vented exterior building wall including a stud wall which enhances the insulating qualities between the outside and inside of the wall.

Still another object is to provide an exterior building wall or roof which is vented for air circulation in a manner permitting efficiently utilization of solar heat.

A still further object is to provide a vented roof structure which may advantageously be employed in conjunction with an interior, cathedral-type ceiling.

Another aspect of the invention is concerned with an angle bracket or plate for use in cutting and constructing roof rafter members and which advantageously may be employed with the roof structures of the invention.

In a more general sense, the object of the invention is to provide a building wall and/or roof construction which is ventilated for energy efficiency, and may include other features which promote ease and economy of handling and construction, added insulating qualities, and others.

Other objects will in part be obvious and will in part appear hereinafter.

SUMMARY OF THE INVENTION

In accordance with the foregoing objects, the invention envisions an exterior building wall construction having the usual stud wall comprising a plurality of spaced, vertically arranged stud members extending between horizontal top and bottom plates covered on both sides by sheets of interior and exterior sheathing material. The layer or layers of exterior sheathing are spaced from the adjacent structure by a pair of generally U-shaped configuration and have a multiplicity of small, closely spaced perforations to allow free passage of air into the space while preventing entry of insects, small animals or other foreign objects or material. The channel members may be attached directly to the stud wall or to other sheathing layers inside the outermost layer, and means may be provided for selectively closing off entry of air into the lower end of the space.

The studs may advantageously be formed as web-type members having a pair of wooden members with grooves formed in one face and extending the length thereof with marginal edge portions of a web material engaged in the grooves and holding the wooden members in spaced relation. The web material may extend the full length of the wooden members or may be provided in separate panels, spaced along the length of the wooden members, and may be of any suitable material, some of which provide features enhancing the qualities of the wall. For example, the improved heat and sound insulating qualities provided by a web material of low density fibreboard are described in applicant's U.S. Pat. No. 4,488,390. A web member of fireproof or fire retardant material, such as gypsum board, provides protection against burn-through of the wall, a quality further enhanced by providing the top and bottom plates in the form of web members of the same material as the studs, such as described in co-pending application Ser. No. 682,162, now abandoned, filed concurrently herewith. Panel members may be provided between the inner and outer sheathing layers of the wall to divide the space into two or more compartments which may be utilized, according to the present invention, for ventilation and energy efficiency. Ductwork and fans may also be provided, if desired, to direct air from one enclosed space to another.

The vented wall constructions may also be applied to roof structures, permitting an enclosed space to be vented to the atmosphere or to another enclosed space for optimum energy utilization. In one embodiment, a web-type structural member is incorporated in a roof rafter to provide a vented roof with a cathedral-type ceiling, one of the wooden members of the rafter remaining exposed on the inside of the ceiling to provide an "exposed beam" appearance. A rigid angle bracket member is also disclosed and may advantageously be employed both as a tool to insure proper cutting of the rafter members to obtain the desired roof pitch. and as an element in the rafter itself.

DETAILED DESCRIPTION

Figure 1:
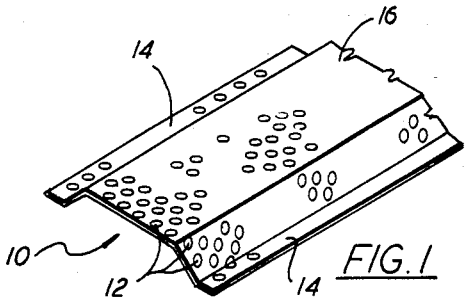
FIG. 1 is a fragmentary, perspective view of a vent member used in the wall and roof structures of the invention.

Referring now to the drawings, in FIG. 1 is shown a fragment of vent channel 10, comprising an elongated strip of material such as sheet aluminum or other non-corrosive material, having closely spaced perforations 12. Vent channel 10 has an essentially U-shaped cross section, including flanges 14 adjacent each marginal edge and lying in the same plane, and medial portion 16, lying in a plane parallel to and spaced from that of flanges 14. Vent channel 10 is utilized in the vented wall and roof constructions to extend across a space between two sheathing layers or other portions of a structure to permit passage of air through the perforations while effectively preventing entry of insects, rodents, and other foreign matter.

Figure 2:
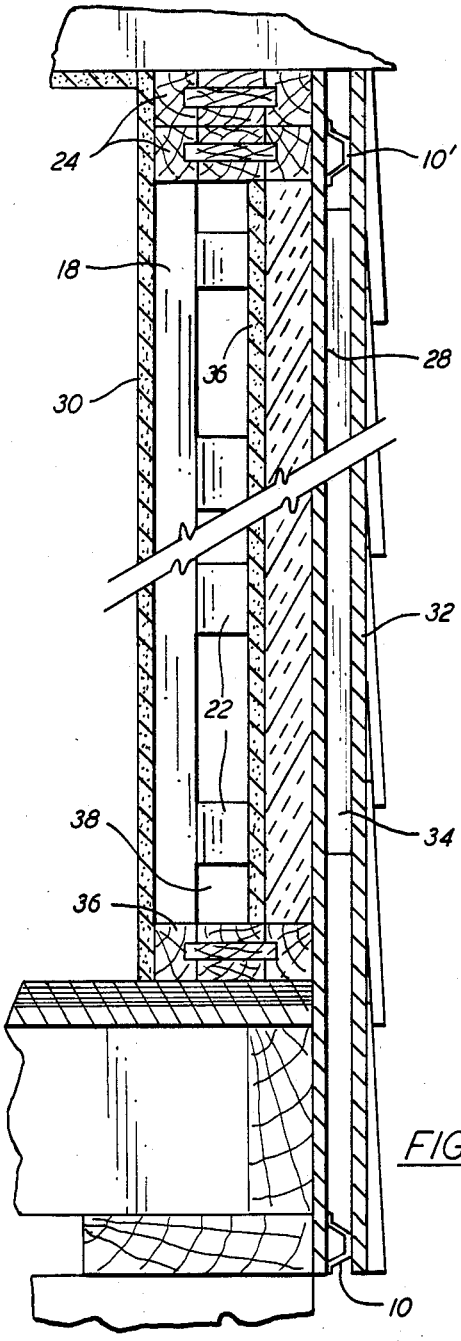
FIGS. 2 and 3 are elevational views in section of building wall constructions incorporating the vent member of FIG. 1.
Figure 3:
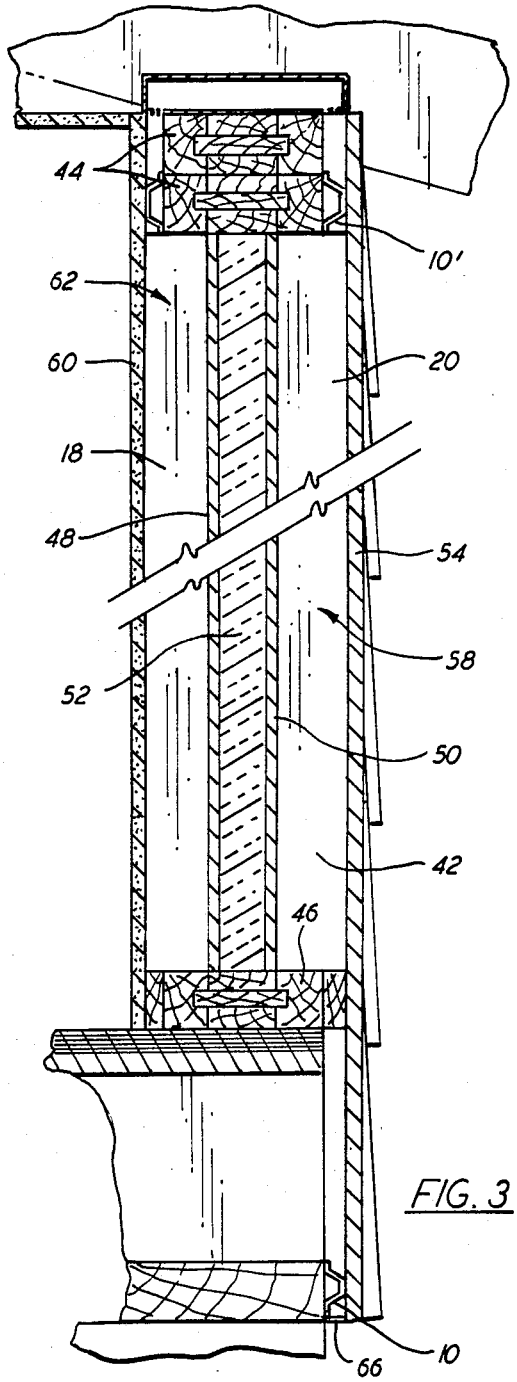

Wall constructions incorporating vent channels 10 are shown in vertical cross section in FIGS. 2 and 3. The illustrated form of the wall constructions includes studs, top plates and sills or bottom plates in the form of web-type members such as those shown in the present inventor's earlier referenced patent and/or copending application, to which reference may be made for additional details of the wall constructions shown herein. As will be apparent, however, the vented wall construction may, in certain embodiments, be formed with the usual, solid, wooden studs, plates and sills. The studs are formed by a pair of wooden members 18 and 20, permanently joined by a web member 22 which may extend the full length of the wooden members or be provided in a plurality of spaced sections, as shown. The top and bottom plates are generally denoted by reference numerals 24 and 26, respectively, being joined in the usual manner to the upper and lower ends of the studs. Exterior and interior sheathing layers 28 and 30 are affixed to wooden members 18 and 20, respectively. A continuous strip of vent channel 10 is affixed, e.g., by nailing through flanges 14, to the outside of sheathing layer 28, preferably along the entire length of the wall near the lower end. A second vent channel 10' may be affixed to sheathing layer 28 near the upper end, i.e., adjacent top plate 24, if desired.

An outer sheathing layer 32 is affixed to the outside of the wall structure, spaced from layer 28 by the depth of vent channel 10. In order to provide nailing surfaces, firring strips 34 are attached to the outside of sheathing layer 28 along the stud members. Thus, except for that occupied by the firring members, the space between sheathing layers 28 and 32 is open to allow for passage of air while vent channels 10 and 10' present any unwanted foreign matter from entering the space. At the upper end (above vent channel 10') this space may communicate with an enclosed plenum above the ceiling, within the walls, or at any other desired location within the building which incorporates the wall structure, as will appear later in more detail, or may be vented back to the atmosphere. In the wall structure of FIG. 2, panel member 36 extends between top and bottom plates 24 and 26, one such panel member between each successive pair of studs, and retained in position at the vertical edges by spacer member 38, with insulation 40 between panel member 36 and sheathing layer 28, as described in the earlier referenced copending application.

The wall structure of FIG. 3 likewise includes web-type stud members 42, and top and bottom plates 44 and 46, respectively. In addition, two interior panel members 48 and 50 are provided, each abutting one of the two wooden members of studs 42, with a layer of insulating material 52 therebetween. In this construction, studs 42 extend outwardlyd, past top and bottom plates 44 and 46, for a distance equal to the depth of the vent channels. This permits vent channels 10 and 10' to be respectively affixed to the bottom and top plates, or other portions of the structure above and below the studs, with the latter providing nailing surfaces for affixing exterior sheathing layer 54. Thus, rather than two exterior sheathing layers with the vent channels therebetween, the FIG. 3 construction provides only a single such layer (54) with the space between this layer and panel member 50 open, except for those portions occupied by studs 42.

Figure 4:
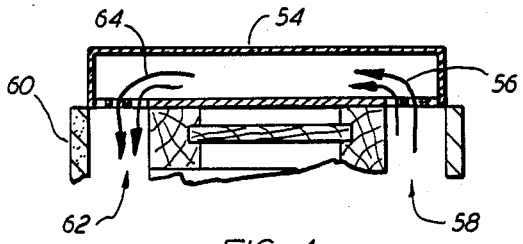
FIG. 4 is an enlarged, elevational view of a portion of FIG. 3.

The vented space communicates at the top, as seen more clearly in FIG. 4, with enclosed plenum or ductwork 54, as indicated by arrows 56, of sheet metal or other suitable material. Ductwork 54 may extend continuously along the upper side of the wall construction, or be interrupted at intervals to provide any necessary clearances for other structural members, such as rafters, joists, roof trusses, etc. On the side opposite the communication with the outside, vented space, (denoted by reference numeral 58) ductwork 54 communicates with the space between interior panel member 48 and internal sheathing layer 60 (denoted by reference numeral 62) as indicated by arrows 64. Studs 42 may be made to the proper dimensions relative to the top and bottom plates either by changing the dimensions of the wooden members or the web members from those shown in the FIG. 2 construction to allow for the overhang of the studs.

In the FIG. 3 wall construction, a baffle or valve means is provided in connection with the vent channel to prevent entry of outside air into space 58 when desired. The valve means may take any desired form, being shown somewhat diagrammatically in FIG. 3 as a plate 66 hingedly connected to vent channel 10 along substantially its entire length for movement between blocking and unblocking positions with respect to space 58. Plate 66 may be spring biased toward one position or the other and maintained in the opposite position by appropriate latch means (not shown). Movement may be manual or automatic, e.g., under the control of a thermostat sensitive to either outside temperature or the temperature within space 58, or the differential between the two.

It should be noted that, although the illustrated form of vent channel 10 is essentially U-shaped, whereby each such channel presents two perforated surfaces through which air passes, other configurations are equally suitable. For example, an L-shaped vent may be provided wherein one side is attached to the building structure and the other (which need be the only perforated side) extends between the structural members defining the entrance to the vented space. Other configurations, suited to the particular combination of structural members bridged by the vent channel, are likewise contemplated.

The indicated venting means for the wall construction can be useful for energy conservation purposes during periods when it is desired to conserve either inside heat (when outside temperatures are below that inside) or inside cooling (when outside temperatures are above that desired inside the structure incorporating the wall). For example, during winter months in cold climates, although the outside temperature may be low, direct solar radiation may heat the air within space 58 to an appreciably higher temperature, particularly if sheathing layer 54 has a southerly exposure and is a good solar collector or conductor, as is preferred. The heated air may then rise within space 58 to ductwork 58 and be conducted therefrom to other parts of the building, possibly but not necessarily through space 62, which may be at a lower temperature and are so located that raising the temperature in this manner contributes to overall energy efficiency of the structure. In some instances it may be desirable to provide a fan or other forced circulating means for conducting the air to or through the desired spaces. During summer months the vented wall structures may be utilized to prevent undesirable build-up of heat in unvented spaces in order to conserve energy utilized to cool the interior.

Figure 5:
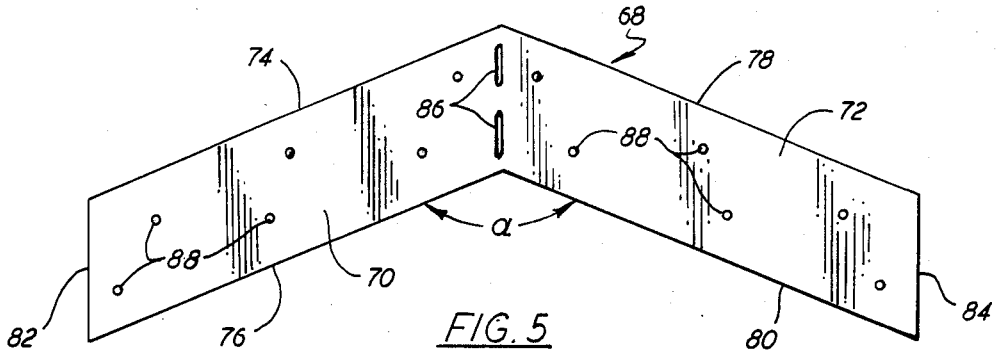
FIG. 5 is a front elevational view of a bracket member used in the roof structures of the invention.
Figure 6:
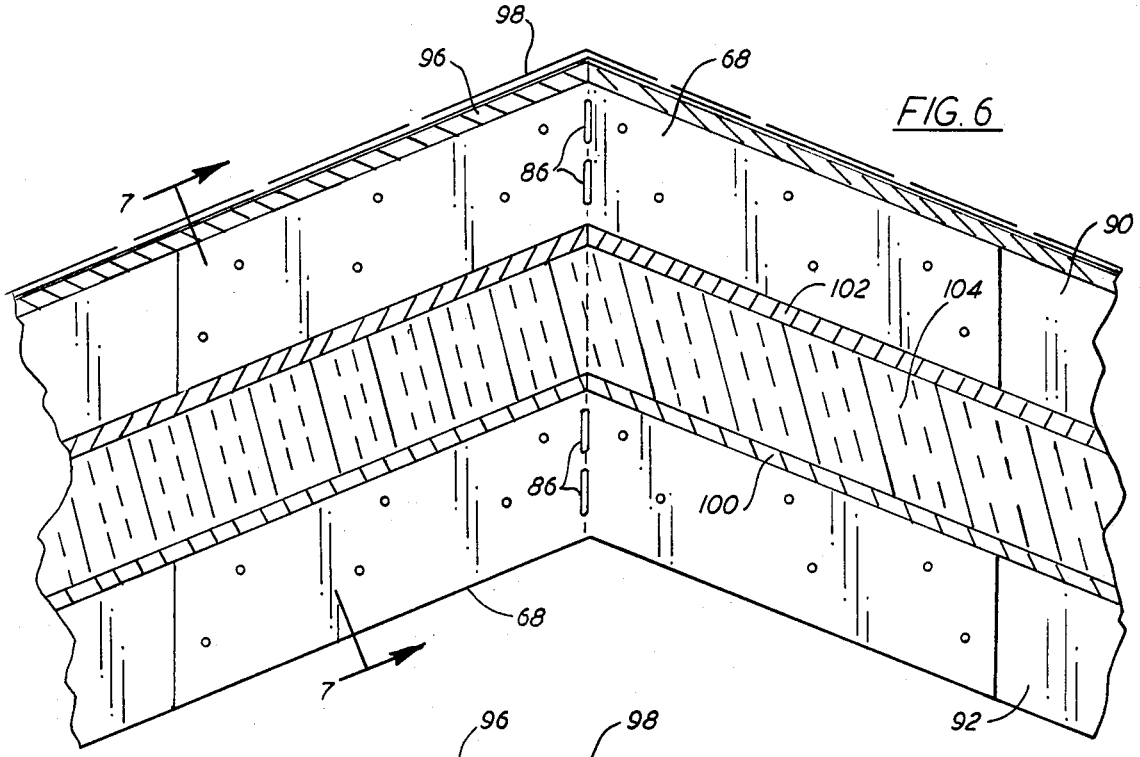
FIG. 6 is a front elevational view of a roof construction incorporating the bracket of FIG. 5.
Figure 7:
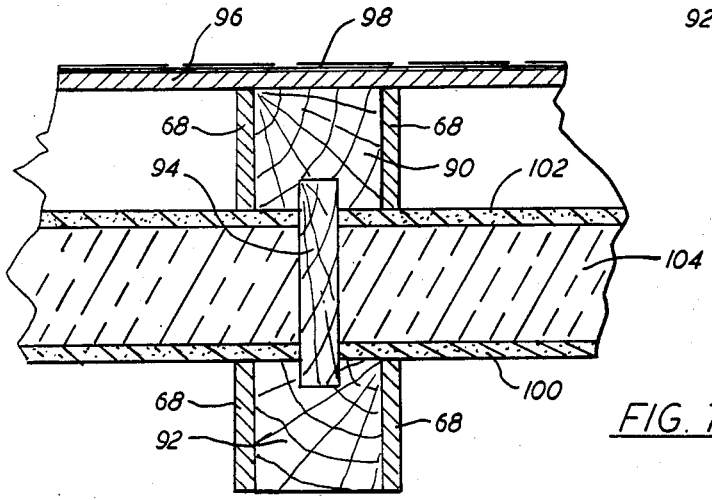
FIG. 7 is a sectional view taken on the line 7—7 of FIG. 6.

Turning now to FIGS. 5–7, a roof construction utilizing the principles of the invention is shown. An element useful in such constructions, and which may be utilized in otherwise conventional roof rafter constructions, is shown in FIG. 5. This element is in the form of an angle bracket, denoted generally by the reference numeral 68, constructed in one piece of a rigid material such as metal of suitable thickness. Bracket 68 includes two arms 70 and 72 each having parallel side edges 74 and 76, and 78 and 80, respectively, and end edges 82 and 84, respectively. Arms 70 and 72 are disposed at a fixed, predetermined angle, i.e., the angle embraced by edges 76 and 80, and thus by edges 74 and 78, being indicated by the letter a. End edges 82 and 84 are disposed parallel to a line bisecting angle a, i.e., parallel to slote 86.

Bracket 68 further includes one or more elongated, through slots 86 disposed on a straight line bisecting angle a between edges 74 and 78 and between edges 76 and 80. Slots 86 are wide enough to permit the end of a marking pencil to extend therethrough and make a mark on a board upon which bracket 68 is resting. Brackets 68 would be fabricated in a number of different angles to conform to various roof pitches, e.g., 3/12, 4/12, 5/12 etc. A bracket conforming to the desired roof pitch is placed upon a board or other structural member to be used in the fabrication of a roof rafter with one of the side edges lying along a side edge of the board. By making a mark through slot 86 the board may be cut at the end forming the upper or ridge end of the rafter at the exact angle required for the desired roof pitch. Likewise, if the rafter is of the type requiring the lower end to be cut to match the ridge end, one of end edges 82 and 84 may be used to mark the board with a side edge of bracket 68 aligned with a side edge of the board. The bracket is moved along the board as required, of course, to obtain the correct length between the rafter or ends of the truss member. A plurality of nail holes 88 are provided through bracket 68 for attachment thereof to the rafter members after marking and cutting.

The structural members shown in FIGS. 6 and 7 as forming the roof rafters are web-type members such as those used for the studs, top plates and bottom plates in the previously described wall constructions. Each roof truss member includes two spaced, wooden members 90 and 92, joined by web member 94. After being marked and cut as described above, the upper or ridge ends of the two truss members are placed in directly abutting relation, with no ridge pole or ridge board therebetween, and joined by nailing one of brackets 68 to wooden members 90 and 92 on each side. One or more brackets 68 may be omitted if the necessary structural integrity of the rafter assembly is maintained.

The rafter assembly so formed is placed in position on the walls of the structure and secured thereto in the usual manner. The roof deck 96 and shingle layers 98 used in the particular construction are secured in place on the rafter system as in conventional roofs. A pair of panel members 100 and 102 are positioned between wooden members 90 and 92 of the rafter member and maintained in position by a resilient batt of insulating material 104 compressed therebetween, as in the wall construction of FIG. 3. If utilized as a cathedral-type ceiling, the lower surface of panel member 100 would be the actual room ceiling and wooden member 92 would be in the nature of an interiorly exposed beam. If it is not desired that brackets 68 be exposed, they may be omitted on the lower wooden members 92 provided the necessary structural rigidity is provided by brackets 68 on each side of wooden members 90.

Thus, the space between panel member 102 and roof deck 96 provides means for venting the roof structure with air which may be connected with one of the previously described plenum means, or the vent space between the outer layers of the wall, or may receive air directly from the outside at the bottom of the rafters with suitable vent channels, as before. The air passing through the roof vent space may be passed back to the atmosphere or communicated to other vent spaces or plenums. Portions of the roof structure other than that directly beneath the roof deck may be vented in addition to, or instead of, the space shown in FIGS. 6 and 7, by rearrangement of the panel members and insulation as, for example, in the previously described wall constructions.

What is claimed is:

1. A building construction having walls and a roof, at least one of which includes structure allowing interior portions thereof to be vented to receive outside air, said structure comprising:

(a) an outer sheathing layer;

(b) an inner panel member supported in spaced, parallel relation to said sheathing layer to define a space therebetween;

(c) at least one member underlying said sheathing layer along an edge portion thereof exposed to outside air with a gap of predetermined width between said one member and said sheathing member edge portion; said gap communicating with said space, (d) a vent channel member affixed to one of said one member and said sheathing member and having a portion extending entirely across said gap and extending the full length thereof, said portion having a plurality of closely spaced, small perforations, thereby permitting essentially free flow of outside air through said gap to said space while blocking entry of insects, and the like, into said space.

2. The invention according to claim 1 wherein said vent channel member is substantially U-shaped and includes a flange portion extending outwardly along each lateral edge, said flange portions lying in a common plane.

3. The invention according to claim 2 wherein said vent channel member further includes a medial portion lying substantially in a second plane, parallel to said common plane and spaced therefrom by said predetermined width.

4. The invention according to claim 1 wherein a wall of said building construction is vented to receive outside air, said wall including stud members of web-type construction, and said panel member extending between each successive pair of studs.

5. The invention according to claim 4 and further including plenum means arranged to receive air passing upwardly through said space.

6. The invention according to claim 1 wherein a roof of said building construction is vented to receive outside air, said roof including rafter members of web-type construction, and said panel member extending between each successive pair of rafters.

7. The invention according to claim 6 wherein said rafter members comprise a pair of elongated wooden members joined in spaced relation by a web member, said wooden members having edge portions extending on each side of said web member, said panel member extending between said web members of successive rafter members and having marginal portions resting against said edge portions of one of said wooden members of successive rafters, and further including a second panel member extending between said web members of successive rafter members and having marginal portions resting against said edge portions of the other of said wooden members of successive rafters, and a layer of insulating material filling the space between said first-mentioned panel member and said second panel member.

8. The invention according to claim 7 wherein said rafter members are joined in pair at a predetermined angle to form a peaked roof.

9. The invention according to claim 8 wherein said pairs of rafters are joined at the peak by at least one angle bracket comprising a one piece, rigid member having two legs each with parallel side edges, said legs being joined at said predetermined angle along a line extending between the juncture of said side edges and having end edges parallel with said line, at least one, elongated, through slot extending along said line, and a plurality of nail holes extending through each of said legs, said member being joined to said rafter members, and thereby joining said rafter members to one another, by nails extending through said holes.

* * * * *